US005533595A

United States Patent [19]

Narumi et al.

[11] Patent Number: 5,533,595

[45] Date of Patent: Jul. 9, 1996

[54] TRACTION-TYPE ELEVATOR

[75] Inventors: Eiji Narumi, Tokyo; Masao Iwasa, Ichikawa, both of Japan

[73] Assignee: Otis Elevator Company, Farmington, Conn.

[21] Appl. No.: 290,199

[22] Filed: Aug. 15, 1994

[30] Foreign Application Priority Data

Aug. 18, 1993 [JP] Japan ..... 5-203515

[51] Int. Cl.[6] ..... B66B 11/08

[52] U.S. Cl. ..... 187/266; 187/260

[58] Field of Search ..... 187/266, 260, 187/254, 406

[56] References Cited

U.S. PATENT DOCUMENTS

| | | | |
|---|---|---|---|
| 772,074 | 10/1904 | Wellman | 187/260 |
| 3,101,130 | 8/1963 | Bianca | 187/266 |
| 5,076,398 | 12/1991 | Heikkinen | 187/266 |

FOREIGN PATENT DOCUMENTS 12609974 7/1988 France .

22201657 9/1988 United Kingdom .

*Primary Examiner*—Kenneth Noland
*Attorney, Agent, or Firm*—Joseph P. Abate

[57] ABSTRACT

In a traction-type elevator equipped with a driving sheave (16) positioned at the top of the shaft for ascent and descent (1), cage sheaves (4, 5) are attached to the upper section of the cage (2) and are inclined in relation to this driving sheave (16), and multiple ropes (12, 13, 14) are wound around the outer surface (4*a*) of this cage sheave and the outer surface (16*a*) of the above-mentioned driving sheave; the traction-type elevator is characterized in that along with making the outer surface (4*a*) of the above-mentioned cage sheave (4) parallel to the outer surface (16*a*) of the driving sheave (16), this cage sheave (4) is divided into multiple sheave pieces (17, 18, 19) according to the abovementioned ropes (12, 13, 14). The ropes (12, 13, 14) are pulled by the driving sheave (16), and even if the cage (2) is caused to move upwardly or downwardly at a high speed, there is essentially no more generation of vibration and noise, because none of the abovementioned ropes (12, 13, 14) twists undesirably.

6 Claims, 5 Drawing Sheets

TRACTION-TYPE ELEVATOR

BACKGROUND OF THE INVENTION

1. Technical Field

This invention relates to a traction-type elevator and particularly to such an elevator in which the cage is moved vertically with ropes via a hoist.

2. Description of the Prior Art

FIGS. 4–6 illustrate conventional traction-type elevators. In FIGS. 4 and 5, a cage (101) is arranged in a vertically movable manner in a channel (102). A pair of sheaves (104) and (105) for the cage is arranged through a cage frame (103) on the upper portion of the cage (101). Multiple ropes (106), (107), and (108) are engaged on cage sheaves (104) and (105). These ropes (106), (107), and (108) are also engaged on a driving sheave (110) of a hoist (109). Also, one end of ropes (106), (107), and (108) is fixed on an overhead beam (111), while the other end is fixed on a counterweight (112). Of course, the hoist (109) or motor is electronically connected to a controller, both connected to suitable electrical power sources, all as is well-known.

As is well known, the diameter of the sheaves (104) and (105) is determined by the size of ropes (106), (107), and (108). Consequently, when sheaves (104) and (105) are relatively larger, it becomes impossible to arrange the sheaves (104) and (105) along the steering the frame (103). Instead, they must be arranged at an angle to frame (103) (that is, diagonal to the cage (101)). Then, multiple ropes (106), (107), (108) are hung on obliquely arranged sheaves (104), (105), and they are hung on the driving sheave (110) above the sheave (104).

For the conventional traction-type elevator with cage sheaves (104) and (105) arranged in the diagonal direction of the cage (101), as shown in FIG. 6, for ropes (106), (107), (108) hung from cage sheave (104) to driving sheave (110), the overall shape of the ropes is slightly twisted. More specifically, as cage (101) moves to the upper floors, the amount of twisting of the overall of said ropes (106), (107), (108) under the action of driving sheave (110), said ropes (106), (107), (108) twist. Consequently, vibration and noise take place (in particular, when cage (101) moves vertically at a high speed.) This is a disadvantage.

It is a principal object of the present invention to solve the aforementioned problems of the conventional methods by providing a traction-type elevator characterized by the fact that the ropes can be hung from the cage sheaves to the driving sheave without twisting; thus, no vibration or noise is generated from the ropes under traction.

According to the present invention, a traction-type elevator includes a driving sheave arranged in the upper portion of the channel, a cage sheave arranged at an angle on the upper side of the cage and opposite to said driving sheave, and multiple ropes hung on the periphery of said cage and the periphery of said driving sheave; in this traction-type elevator, the periphery of said cage sheave is arranged nearly parallel to the periphery of the driving sheave, and said cage sheave is divided into multiple sheave pieces corresponding to said ropes.

Because the periphery of the overall sheave pieces is almost parallel to the periphery of the driving sheave, there is no overall twisting of the multiple ropes hung from said sheave pieces to the driving sheave, and the ropes can become taut without twisting. That is, during the movement of the cage to an upper floor, the ropes have no overall twist. Consequently, even when the multiple ropes are pulled by the driving sheave, and the cage moves vertically at a high speed, the ropes are still free of overall twisting; hence, no vibration or noise is generated.

Further and still other objects of the present invention will become more readily apparent when the following detailed description is taken in conjunction with the accompanying drawing, in which:

DETAILED DESCRIPTION OF THE PREFERRED EMBODIMENTS AND BEST MODE

Figure 1:
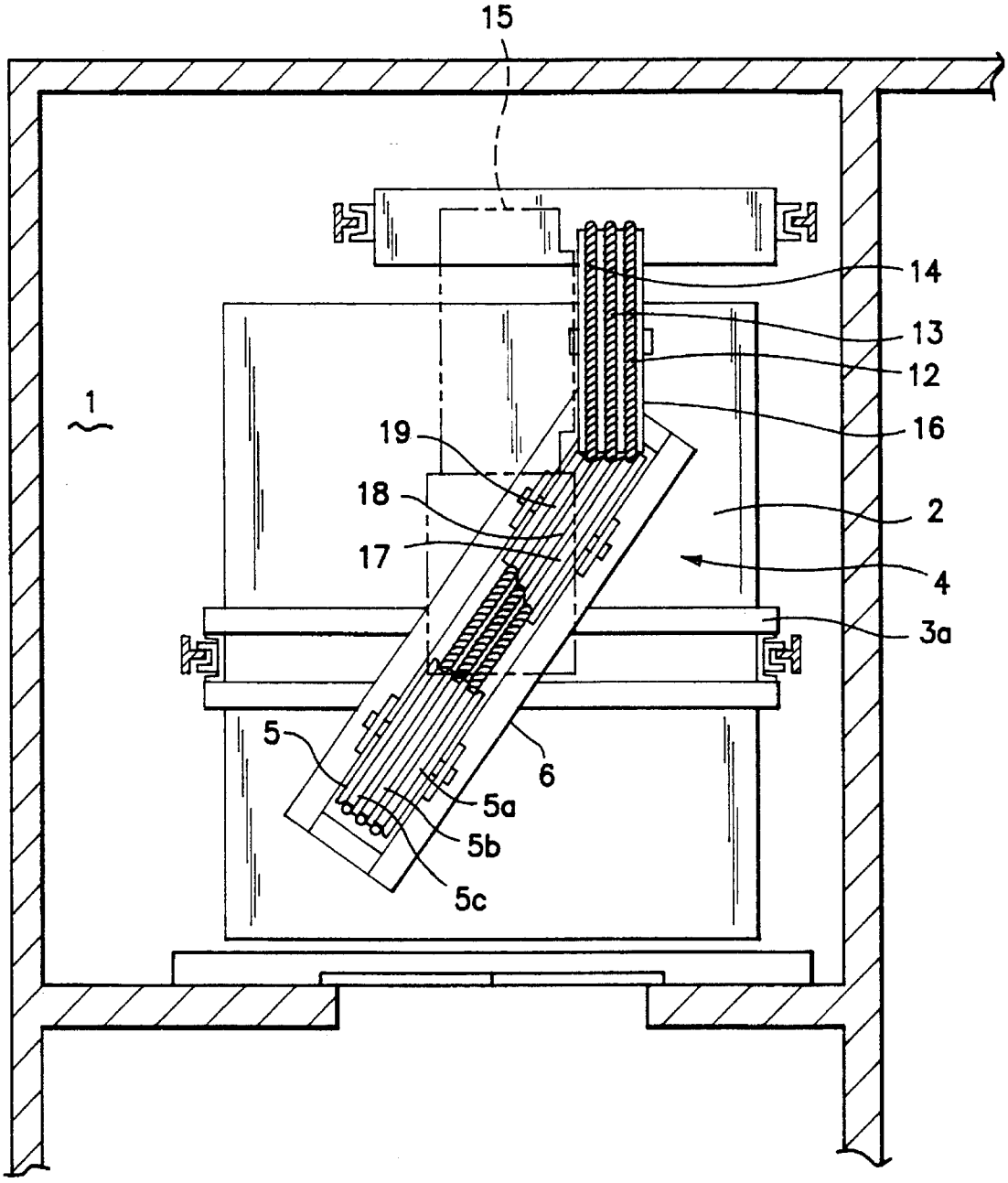
FIG. 1 is a plane view illustrating an application example of the traction-type elevator of this invention.
Figure 2:
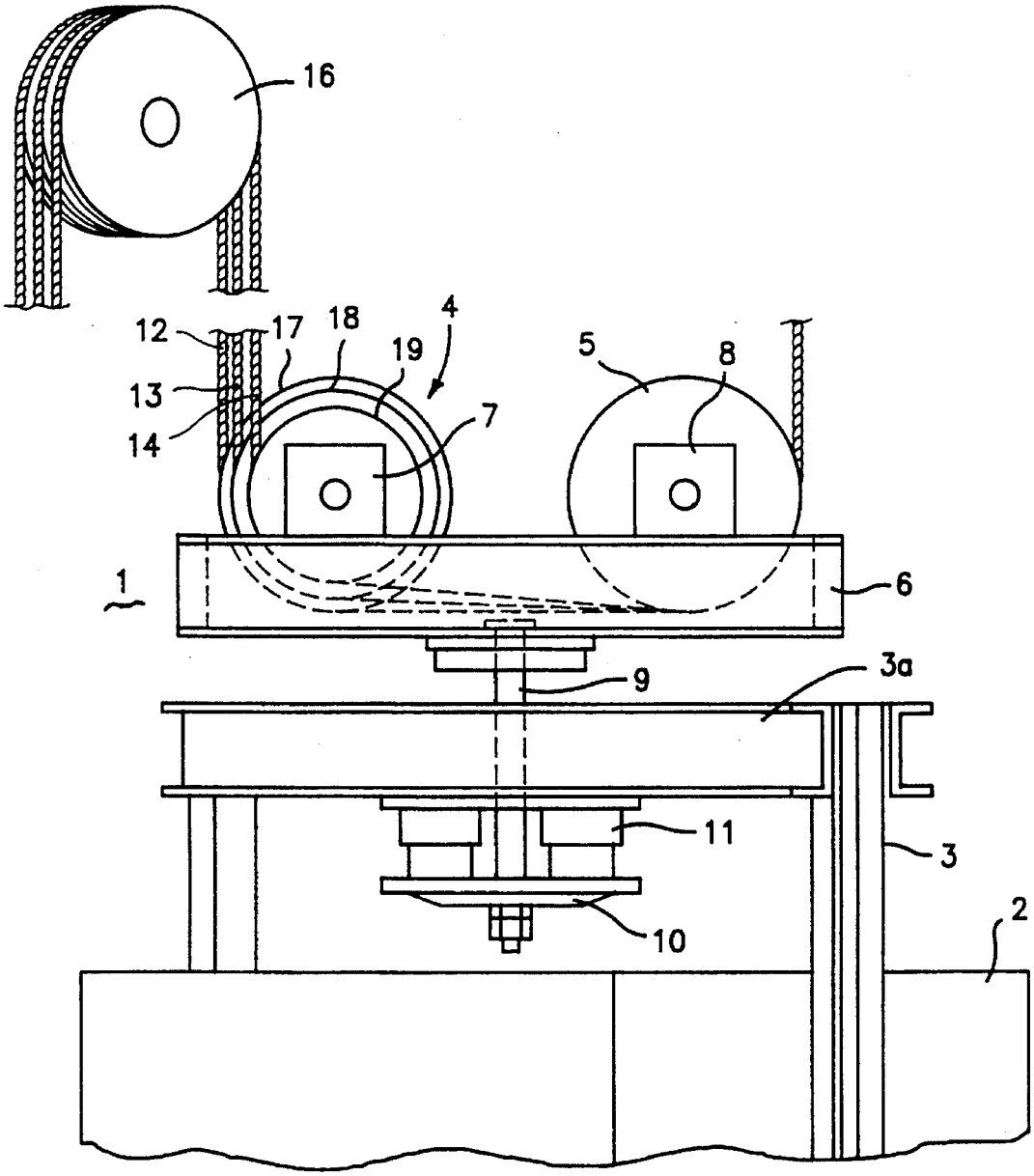
FIG. 2 is a front view of said traction-type elevator.
Figure 6:
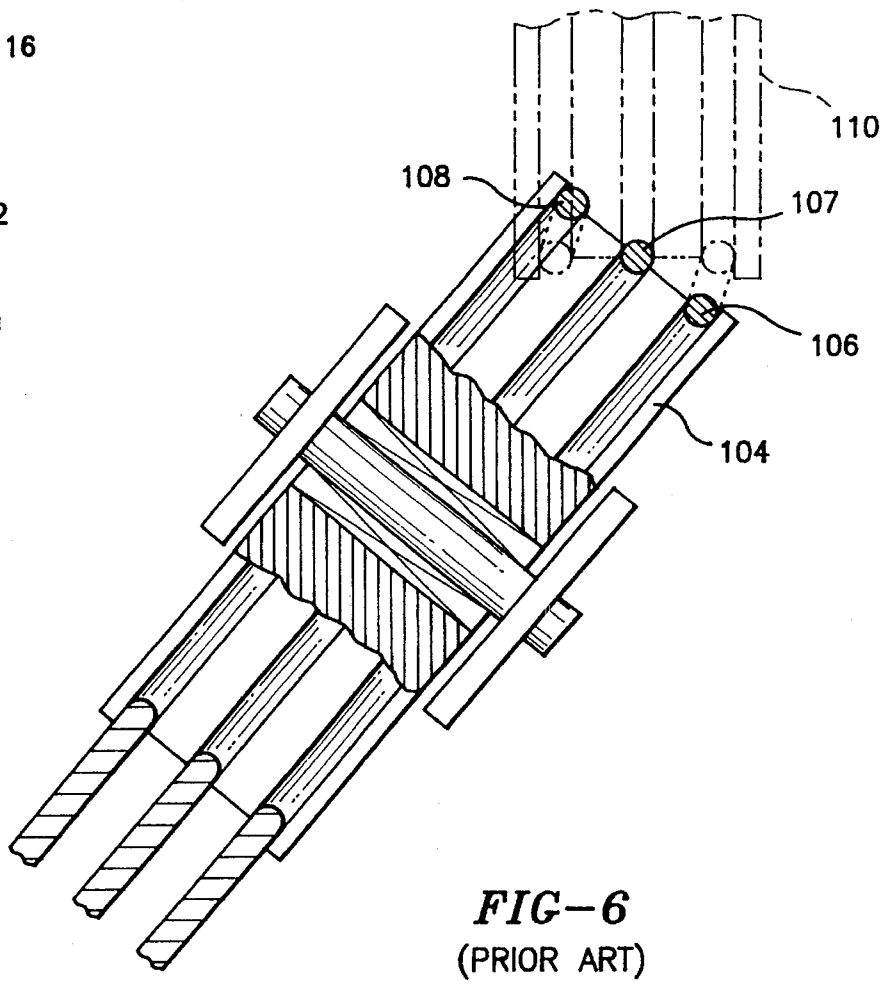
FIG-6 (PRIOR ART)
FIG. 6 is an enlarged plane view of the main portion of said conventional traction-type elevator.
Figure 3:
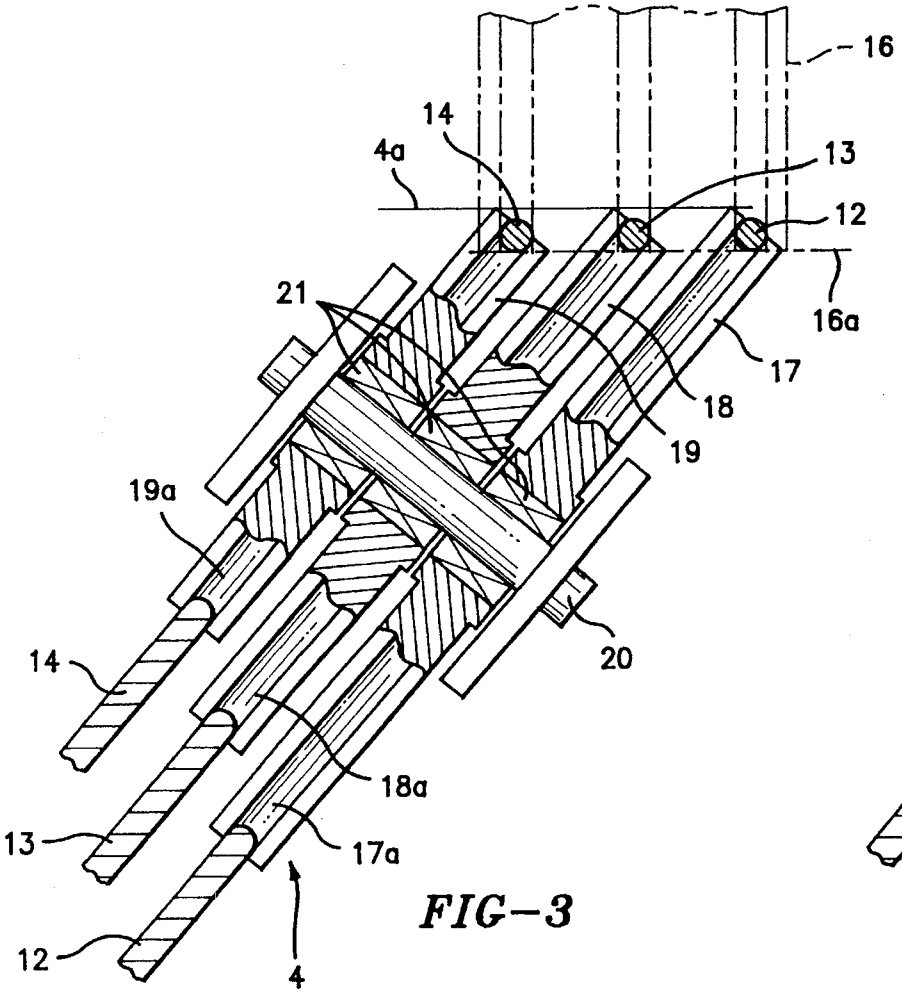
FIG. 3 is an enlarged plane view of the main portion in said traction-type elevator of the invention.
Figure 4:
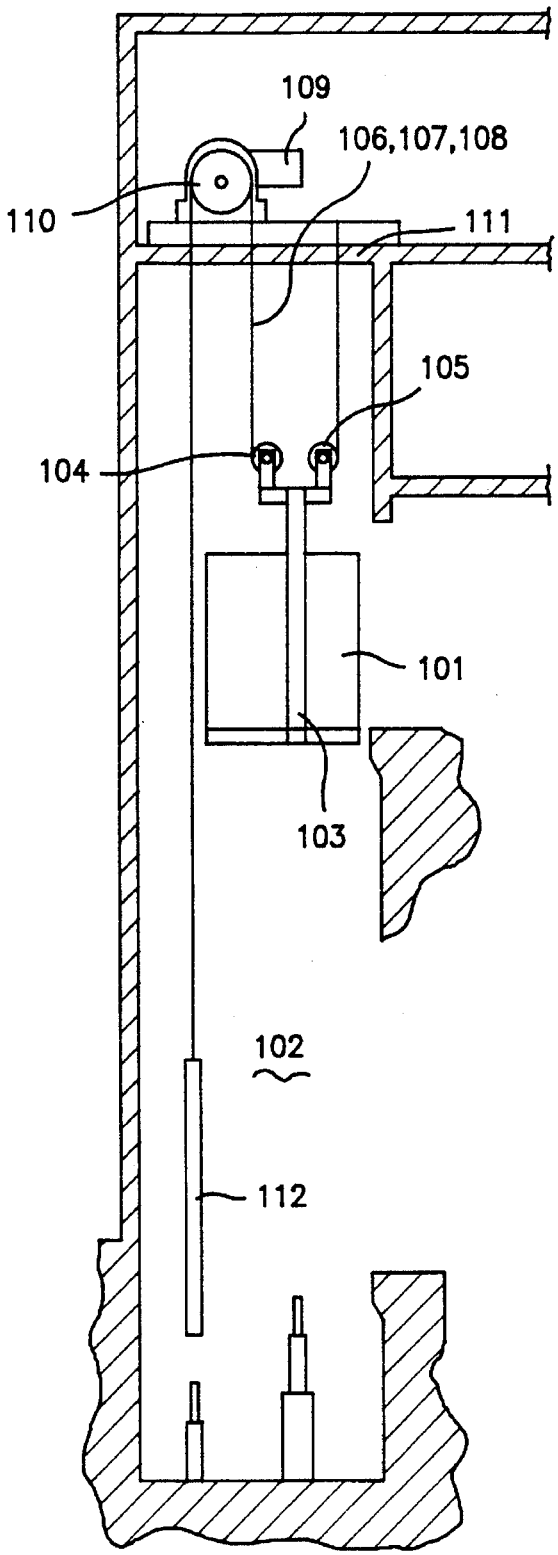
FIG–4 (PRIOR ART)
FIG. 4 is a schematic diagram illustrating a conventional traction-type elevator.
Figure 5:
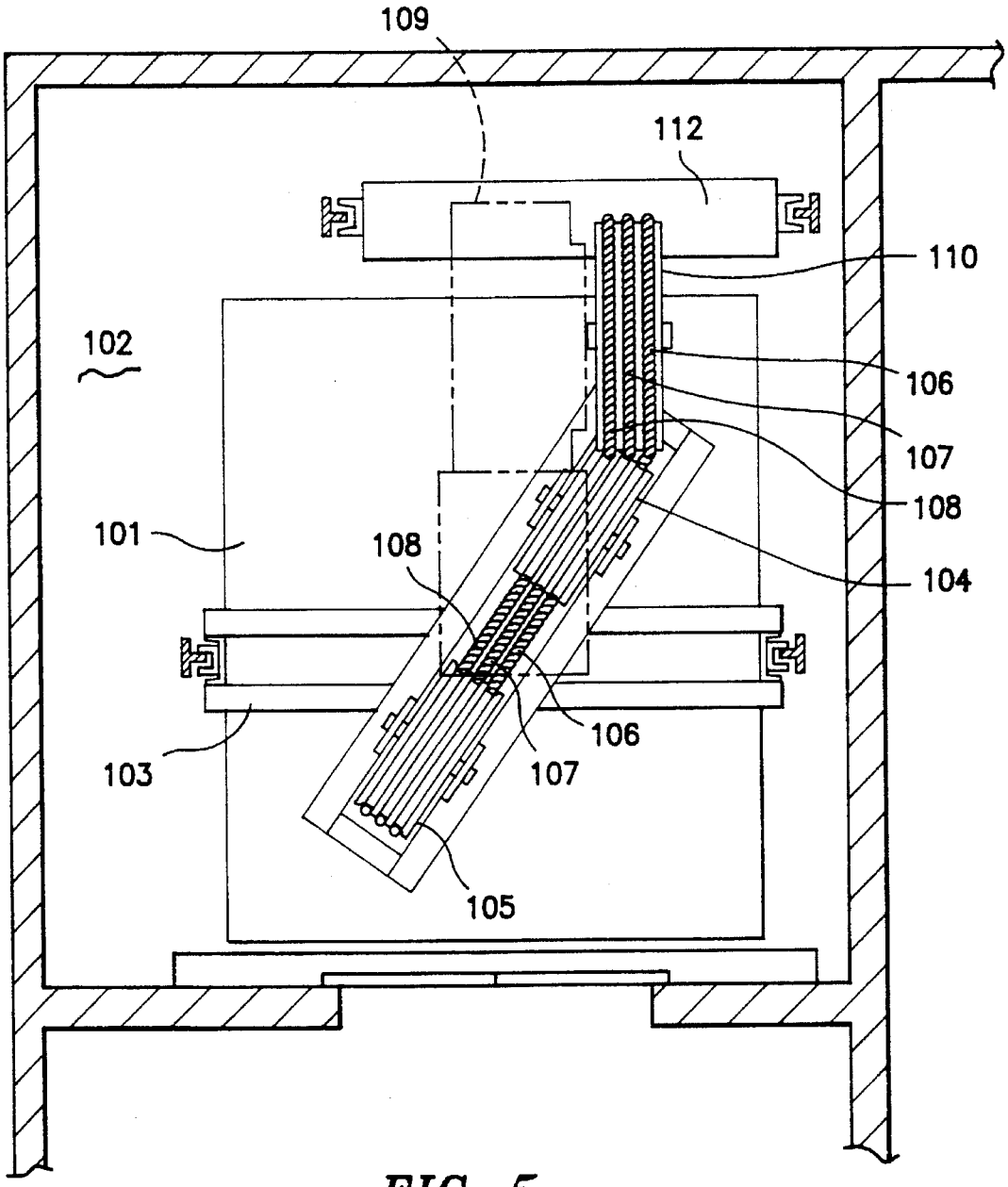
FIG–5 (PRIOR ART)
FIG. 5 is a plane view of said conventional traction-type elevator.

The present invention will be explained in more detail with reference to figures. FIGS. 1–3 are diagrams illustrating an application example of the traction-type elevator according to the present invention. In the FIGS. 1–3, there are shown:

1, channel
2, cage
4, cage sheave
4*a*, periphery
5, cage sheave
12, 13, 14 ropes
16, driving sheave
16*a*, periphery
17, 18, 19 sheave piece.

As shown in FIGS. 1 and 2, in the channel (1) of the elevator, the cage (2) is arranged in a vertically movable manner. In said cage (2), a cage frame (3) is arranged. Above a cross head channel (3*a*) of the cage frame (3), a pair of cage sheaves (4), (5) is arranged. That is, a support channel (6) is arranged above the cross head channel (3*a*). A pair of cage sheaves (4), (5) is installed in a freely rotatable manner through support pieces (7), (8) on said support channel (6). In the support channel (6), a hoisting rod (9) is installed. This hoisting rod (9) is engaged to the cross head channel (3*a*) through a receiving plate (10) and a vibration-proofing part ( 11). In this way, due to the aforementioned reason, for cage sheaves (4), (5) installed on cross head channel (3*a*), the diameter is made relatively large. Consequently, the cage sheaves (4), (5) are arranged in the diagonal direction of the cage (2) (the diagonal direction in FIG. 1).

Multiple (plurality) ropes (12), (13), (14) are hung on cage sheaves (4), (5). These ropes (12), (13), (14) are hung on the driving sheave (16) of a hoist (15) arranged in the machine chamber or room. Also, one end of the ropes (12), (13), (14), is fixed to the overhead channel (not shown in the figure) in the upper portion of the channel, while the other end is fixed to a counterweight (not shown in the figure) arranged to balance the weight of the cage (2). In this case, because the hoist (15) is arranged toward the cross head channel (3*a*) (the right in FIG. 1), the cage sheaves (4), (5) are oriented at an angle with respect to the driving sheave (16).

Of cage sheaves (4) and (5), one cage sheave (5) has rope grooves (5*a*), (5*b*), (5*c*), in which said multiple ropes (12), (13), (14) are fit or disposed, formed on its periphery. Also, as shown in FIG. 3, the periphery (4*a*) of the other cage sheave (4) is nearly parallel to the periphery (16*a*) of the driving sheave (16), and is divided into multiple sheave pieces (17), (18), (19). On the sheave pieces (17), (18), (19), rope grooves (17*a*), (18*a*), (19*a*) are formed, respectively. These sheave pieces (17), (18), (19) are supported through bearings (21) on a shaft (20) and can rotate independently. As shown in FIG. 3, the diameter decreases as the position moves to left side for the sheave pieces (17), (18), (19). The ropes (12), (13), (14) hung on the sheave pieces (17), (18) and (19) are also hung on driving sheave (16). Because the diameter becomes smaller in said order for the sheave pieces (17), (18), (19), there is no overall twisting of the ropes (12), (13), (14) hung from the sheave pieces (17), (18), (19) to the driving sheave (16). That is, during movement of the cage (2) to the upper floor, the ropes (12), (13), (14) have, on the whole, no twisting. Consequently, even when the cage (2) moves at a high speed as ropes (12), (13), (14) are pulled by the driving sheave (16), the ropes (12), (13), (14) do not twist on the whole. Consequently, no vibration or noise is generated.

As explained above, because the periphery of the cage sheave is arranged almost parallel to the periphery of the driving sheave, and the cage sheave is divided into multiple sheave pieces corresponding to the multiple ropes, even when the cage moves vertically at a high speed as the ropes are pulled by the driving sheave, said ropes do not twist on the whole, and no vibration or noise generated. Each of the rope grooves (17*a*), (18*a*), (19*a*), of the cage sheave (4), at least partly, overlaps with the grooves of the driving sheave (16).

While there has been shown and described what is at present considered preferred embodiments of the present invention, it will be apparent to those skilled in the art that various changes and modifications may be made therein without departing from the spirit and scope of the present invention which shall be limited only by the appended claims.

What is claimed is:

1. In a traction-type elevator comprising a driving sheave positioned at a top of a shaft for ascent and descent, a plurality of cage sheaves attached to an upper section of the cage and inclined in relation to the driving sheave, and multiple ropes wound around outer surfaces of the cage sheaves and an outer surface of the driving sheave; characterized in that the outer surface of one cage sheave is parallel to the outer surface of the driving sheave, that the one cage sheave is divided into multiple sheave pieces according to the multiple ropes, and that at least two of the multiple sheave pieces have different diameters.

2. An elevator as claimed in claim 1, wherein said plurality is two.

3. An elevator as claimed in claim 1, wherein said multiple is three.

4. An elevator as claimed in claim 1, wherein the outer surface of the one cage sheave is a periphery of the one cage sheave, and wherein the outer surface of the driving sheave is a periphery of the driving sheave.

5. An elevator as claimed in claim 1, wherein each of the multiple sheave pieces has a different diameter.

6. An elevator arrangement, comprising:

a drive sheave having a periphery;

a cage;

a cage sheave arranged on the cage, the cage sheave including multiple sheave pieces having different diameters and including a periphery, the periphery of the cage sheave being nearly parallel with the periphery of the drive sheave.

* * * * *